US006412433B1

(12) United States Patent
Breivik et al.

(10) Patent No.: US 6,412,433 B1
(45) Date of Patent: Jul. 2, 2002

(54) FSO LOADING/MOORING

(75) Inventors: Kåre Breivik, Tau; Harald Kleppestø, Bryne, both of (NO)

(73) Assignee: Navion AS, Stavanger (NO)

( * ) Notice: Subject to any disclaimer, the term of this patent is extended or adjusted under 35 U.S.C. 154(b) by 0 days.

(21) Appl. No.: 09/601,797

(22) PCT Filed: Feb. 8, 1999

(86) PCT No.: PCT/NO99/00041

§ 371 (c)(1),
(2), (4) Date: Sep. 20, 2000

(87) PCT Pub. No.: WO99/42358

PCT Pub. Date: Aug. 26, 1999

(30) Foreign Application Priority Data

Feb. 10, 1998 (NO) ..... 19980579

(51) Int. Cl.[7] ..... B63B 21/00

(52) U.S. Cl. ..... 114/230.1; 414/137.9; 141/382

(58) Field of Search ..... 414/137.9, 138.2, 414/138.4, 139.2; 114/230.1, 230.2, 230.24; 141/382–387, 233, 231, 279, 284

(56) References Cited

U.S. PATENT DOCUMENTS

| | | | | |
|---|---|---|---|---|
| 1,685,927 A | * | 10/1928 | Miller | |
| 3,746,060 A | * | 7/1973 | Janssen et al. | 114/387 |
| 3,833,032 A | * | 9/1974 | Hnot | 114/232 |
| 4,064,820 A | * | 12/1977 | Vogt | 114/74 R |
| 5,065,687 A | | 11/1991 | Hampton | 114/230 |

FOREIGN PATENT DOCUMENTS

| | | |
|---|---|---|
| DE | 3 026 836 | 2/1982 |
| GB | 1 384 983 | 2/1975 |

* cited by examiner

*Primary Examiner*—Ed Swinehart
(74) *Attorney, Agent, or Firm*—Foley & Lardner

(57) ABSTRACT

The invention concerns an arrangement for load transfer between the stern of a first vessel and the bow of a second vessel. Two bow hawsers are arranged to run from each of their anchor points near the sides of the ship at each side of the stern, to the bow, with the hawsers having approximately the same length. A loading hose is arranged to run centrally from the middle point of the stern of the first vessel to the bow of the second vessel.

21 Claims, 2 Drawing Sheets

FSO LOADING/MOORING

FIELD OF THE INVENTION

This invention relates an arrangement for load transfer, especially of petroleum fluids, between two vessels at sea, comprising at least one bow hawser and at least one loading hose arranged to be drawn between the stern of a first vessel and the bow of a second vessel.

BACKGROUND OF THE INVENTION

Load transfer between two vessel units at sea is a very demanding task, especially due to frequently occurring relative movements between the vessels. A known method to perform this kind of operations is to keep the vessels in a tandem arrangement, i.e. that one of the vessels is kept moored from its bow to the stern of the other vessel. Typically the latter of these may be a so called FPSO (Floating Production, Storage and Off-loading), while the first mentioned may be a tanker, especially a shuttle tanker. Normally one single nylon hawser is used for the moorage, because such hawsers are rated for the large forces which may occur, which depends primarily on the tonnage of the vessels. A typical break load for the nylon hawser may be about 550 tonnes. To use nylon hawsers is advantageous because that material gives a certain elasticity or spring effect by relative movement between the two vessels. The vessel separation may be about 50 to 90 meters, whereas a relatively narrow separation is adjusted to, if a stiffer connection is wished, while a wider separation arranged will result in a more flexible connection or moorage.

Obviously such operations entail large strains under bad weather conditions with wind and waves. The two vessels in such a tandem arrangement may move relative to each other both in the longship and athwart directions. With conventional moorage methods, experience shows that it is needed to use advanced and expensive dynamic positioning systems, especially for shuttle tankers, with its bow moored to the stern of an FPSO-vessel. Despite the known precautions taken in such an arrangement, it happens that the vessels touch each other or even collide. This of course implies a considerable risk with regard to safety and economy.

By a method according to the above mentioned, with a more or less conventional tanker is going to receive a fluid load from an FPSO, the loading hose is led from the stern of the FPSO and back along the side of the hull of the tanker in order to be connected to a manifold or similar equipment which in the usual manner is to be found near midship of the tanker vessel. However, arrangements are also known with the loading hose led from the stern of the stationary FPSO-vessel to the bow of a tanker, e.g. an especially adapted shuttle tanker, which advantageously may carry advanced equipment for dynamic positioning for this purpose. An other possibility is that the tanker vessel is assisted by a tender at its stern, in order to keep the tanker vessel at safe distance from the stern of the FPSO-vessel. The FPSO-vessel may also carry a loading hose carrying boom reaching out over the stern.

SUMMARY OF THE INVENTION

On the background of the known art described above, the invention concerns an arrangement for load transfer between the stern of a first vessel and the bow of a second vessel, comprising two bow hawsers arranged to run from each their anchor points near the sides of the ship at each side of the stern, to the bow, with approximately the same length of the two hawsers, and that the loading hose is arranged to run essentially centrally from the middle point of the stern, to the bow.

In this way a mooring is achieved with the mentioned second vessel, e.g. a shuttle tanker, with its bow position held nearly fixed with respect to the centre line of the first vessel, such as an FSO- or an FPSO-vessel. The hawsers and the loading hose of the preferred embodiment will be stored on board of the FSO/FPSO-vessel.

Among the achieved advantages with such a solution is especially a strongly improved safety of the actual operations together with a reduced demand for advanced dynamic positioning equipment. Further, the effect of weather and wind waves will be less than in the known arrangements and operations, partly due to that the first vessel will act as a breakwave for the second vessel.

The advantageous moorage conditions achieved obviously depend on the relative length dimensions, that is the basic triangular geometry of the arrangement. Clearly the hawsers cannot have a length shorter than a certain minimum because this would bring the vessels too close to each other. On the other hand, too long lengths of the hawsers would imply that the steering or centering effect on the mentioned bow in relation to the centerline of the stationary vessel would be weak. Consequently, according to the invention, it is to prefer that the lengths of the hawsers are of comparable length with the mutual distance with the anchor points on each side of the stern of the first vessel. This may imply that the hawsers' lengths are up to 1.5 or even 2 times the mentioned mutual distance. In this connection it is worth while noting that the first vessel, such as an FPSO, normally is of considerable dimensions, and thus with a corresponding width of the stern.

As will emerge from the following, it may, for certain conditions and operations, be safeguarded considerable advantages by using two pairs of hawsers and/or by arranging extension devices for the hawsers, in order that the hawsers be of increased effective length while keeping a reasonable mutual separation between the vessels.

The solutions comprised by the inventions may be adapted for several different areas of use and operations, such as:

- A more or less stationary vessel of the FSO- or FPSO-type situated in areas with high risk weather, eventually under milder weather conditions.
- That the load to be transferred is petroleum fluids.
- Transfer of liquid gas (LNG, LPG, NGL) and other corresponding or demanding products.

In this connection it shall be noted that especially by the above mentioned known tandem operations by two vessels under conditions or in situations as mentioned in the previous passage, the known moorage methods often imply considerable problems, especially about relative movements of the two vessels with regard to athwart, longship and rotational movements.

Such undesirable movements will by means of the arrangement according to the invention be stabilized to a considerable degree, which may be supported by ensuring a continuous even drag astern from the other [trailing] vessel which bow is connected with the leading vessel.

BRIEF DESCRIPTION OF THE DRAWINGS

The invention will be described in more detail below, with reference to the examples of embodiments which are schematically illustrated in the drawings.

DETAILED DESCRIPTION OF THE PREFERRED EMBODIMENTS

Figure 1:
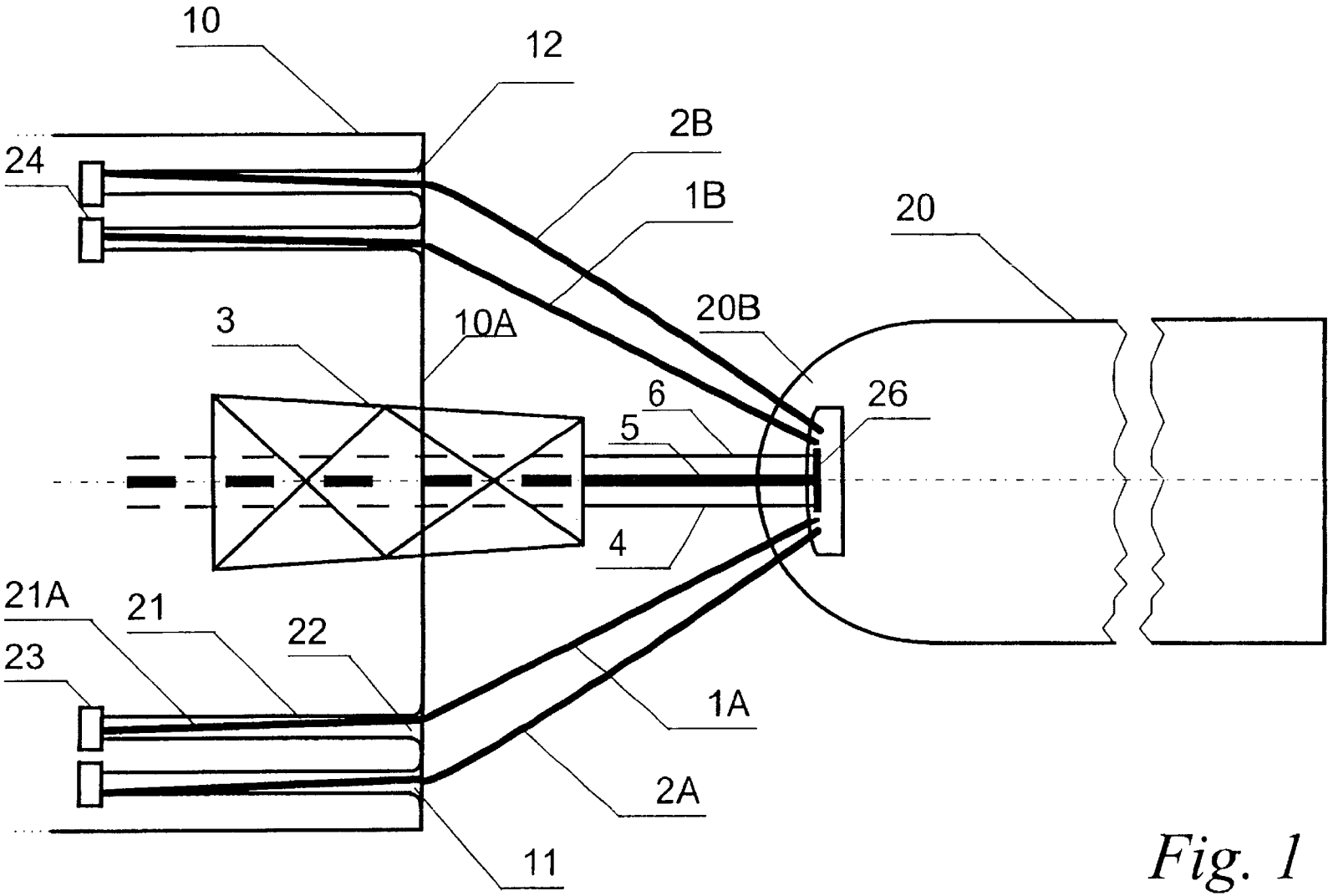
FIG. 1 shows from above an arrangement according to the invention under a load transfer operation.

FIG. 1 of the drawings shows the stern of a first vessel 10 (typically an FSO or an FPSO) and an other vessel 20 which from its bow with corresponding equipment or components 20B is connected with the stern 10A of the vessel 10. The connection comprises a first pair of hawsers 1A,1B and another pair of hawsers 2A,2B and centrally arranged loading hoses 4, 5 and 6. These are in this case led out over an hose boom 3 from the vessel 10. Such a boom may among other things be used for directing the hose or tubes toward the bow 20B of the vessel 20.

The four hawsers are distributed in a way that pairs of hawser extend from the hawser pipe or anchor point indicated by 11 and 12, respectively, on either side of the stern 10A and toward their respective sides of the ship. In this connection it is important that the hawser length 1A is approximately of equal length with the hawser length 1B, and similarly that the hawser length 2A is approximately equal to the hawser length 2B. The pair of hawsers 1A,1B is shown somewhat more tensioned than the pair of hawsers 2A,2B, indicating that in the situation shown in the drawing the air of hawsers 1A,1B takes up a larger proportion of the load than the pair of hawsers 2A,2B.

The embodiment shown in the drawing there are hawser extensions which for the hawser 1A is denoted 21, such that the total effective length of this hawser is increased with an additional length 21A furnished by the hawser extension 21. This extends from a hawsepipe 22 by the stern 10A and forward in the longship direction to a hawser anchor point 23, arranged to resist the rather large straining forces which may be imparted by the hawser 1A. Corresponding hawser extensions are shown for all four hawsers, in that only one more hawser anchor point 24 is indicated for the hawser 1B.

From the above explanation it emerges that the triangular configuration being comprised by the stern 10A and the respective free hawser lengths from the shown hawser guide bushings 11 and 12, to the bow 20B, principally becomes an isosceles triangle which gives a very stable and safe positioning or guidance of the bow 20B of the vessel 20 with regard to the vessel 10A and its centerline. In this triangular configuration it is of course the mutual separation between the anchor points 11 and 12 which plays the role as the base line.

The principal effect by such an arrangement will evidently be possible also by a slightly simplified embodiment with respect to what is explained above in connection with FIG. 1. In this embodiment (not shown), one pair of hawser may be sufficient, such as the hawsers 1A and 1B, and the hawser extensions shown will not always be necessary. In the latter case a necessary hawser anchor point marked by 23 and 24 will be arranged near the stern 10A in a more conventional way according to traditional moorage methods.

The hawsers 1A and 1B are of equal length, as mentioned above. The same applies to the hawsers 2A and 2B. As a typical example the pair of hawsers 1A,1B are 10 to 20% shorter than the pair of hawsers 2A,2B. When the mutual separation between the vessels 10 and 20 thus increases, the pair of hawsers 1A,1B will take up the load. If the stretch load in that pair of hawsers increases more due to relative movement between the two vessels, the pair of hawsers 2A,2B will gradually begin to take their share of the total load. Thus there arises a flexibility or yield in the mutual mooring, being very advantageous for the entire arrangement's way of working.

It is also possible to achieve a corresponding effect with two pairs of hawsers which have the same length, but where the pairs of hawsers have different elasticity properties, achieved i. e. by an appropriate choice of materials or cross-section dimensions.

If one single hawser in the above described arrangement with double pairs of hawsers should become break or fail, a safe moorage between the two ships will still be present, even though there would have been a tendency toward taking a new relative thwartships position.

The described hawser arrangement comprises such a fastening of the hawsers in the bow 20B of the vessel 20, that an even or symmetric balance of force is maintained. This may be arranged by means of known mooring means or devices in the bow 20B.

When the vessel 20 has finished loading it or unloading is disconnected from the vessel 10, the free ends of the hawsers 1A, 1B, 2A, 2B be gathered by a suitable arrangement and stored on the deck. The loading hose or hoses 4, 5 and 6 may be stored on deck correspondingly.

The extension devices shown for the four hawsers in FIG. 1 will be considerably useful when there is a demand for large elastic capacity of the moorage as seen in the length dimension of the two vessels. The length of these devices as represented by the hawser part 21A in the figure, is adapted to the desired prolongation of elasticity or yield. In such an embodiment the length of the hawser pairs 1A,1B and 2A,2B respectively must be adjusted correspondingly with the aim of achieving the desired operation characteristics of the entire mooring arrangement.

For certain operations an arrangement comprising three hoses 4, 5, and 6 such as shown in FIG. 1 are of great interest. This applies to among other things to loading of oil with return of VOC (Volatile Organic Compounds) gas from the vessel 20 to the main vessel 10. An other example is loading of liquid gas. In both of these kinds of operations one will demand that the tank vessel 20 is held in a sufficiently permanent and centered athwartships position behind the vessel 10 to avoid that the hoses should be subject to unfavourable loads. The hose boom 3 may advantageously be arranged to be elevated in order for the hoses not to hang in the sea during the loading operation.

By use of several loading hoses 4, 5, and 6 such as described above, there will be need for a compact bow manifold as a part of the equipment in the bow 20B, aiming at handling several fluid flows. An embodiment for this purpose is shown in FIG. 2 showing a manifold especially adapted for transfer of liquid gas (LNG).

Figure 2:
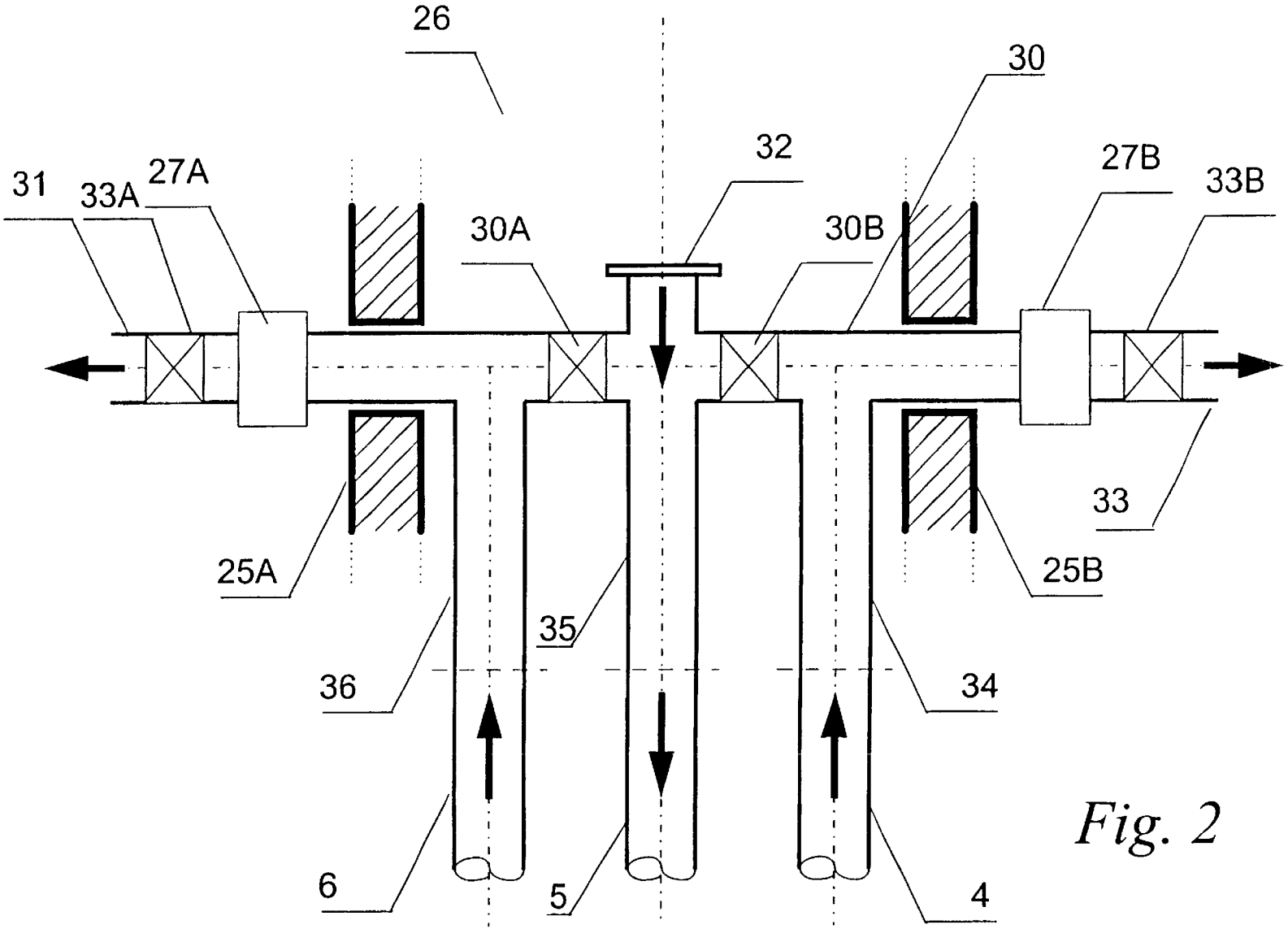
FIG. 2 shows a manifold unit which may be part of the arrangement in FIG. 1.

FIG. 2 shows a manifold arrangement 26 with a through tubular main member 30 with valves, connectors, or flanges and swivels as illustrated. The main body 30 is supported in bearings at 25A and 25B such as outlined in FIG. 2. Thus the main body 30 may perform rotation movements about a horizontal axis lying thwartships in the bow 20B of FIG. 1. Swivels 27A and 27B provide transfer to stationary connectors 31 and 33 with corresponding valves 31A and 33A. Further there is shown valves 30A and 30B in the main body 30. Connection for three fluid flows are indicated by 34, 35, and 36, corresponding to the three hoses 4, 5, and 6. Finally there is shown a connector 32 in FIG. 2.

With a manifold arrangement constructed e.g. as in FIG. 2, it is possible to suitably direct several fluid flows during load transfer through the hoses 4, 5, and 6. Based on corresponding valve settings the fluid flows may be directed according to the arrows in FIG. 2. As an example, the connectors 34 and 36 may receive LNG from an FPSO, while the connector 35 serves for return of gas. With two flows 34 and 36 the flow 34 may be arranged for transfer of petroleum fluid, while flow tube 36 may be arranged for transfer of VOC.

Clearly, a bow manifold in the bow equipment by 20B of a tank vessel 20 may show several different configurations, which may be known in themselves, for handling of fluid flows depending on the actual loading or offloading situation. Also in the mooring arrangement according to FIG. 1 it is possible to make several modifications while keeping the general principle which forms the basis of the solution. Initially we have mentioned that a single pair of hawsers may be sufficient in some instances, and likewise the shown extension devices may be redundant when the demand for a yielding mooring is not especially strict. The anchor points 11 and 12 may instead of more or less traditional hawsepipes comprise pulleys or sheaves which are known as such. Further one may imagine that a double pair of hawsers may have anchor points by the stern 10A, situated one above the other, instead of side by side as illustrated in FIG. 1. In that case, it will be natural to arrange the somewhat tighter pair of hawsers 1A,1B above.

The foregoing description of a preferred embodiment of the invention has been presented for purposes of illustration and description. It is not intended to be exhaustive or to limit the invention to the precise form disclosed, and modifications and variations are possible in light of the above teachings or may be acquired for practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An arrangement for load transfer between two vessels at sea, between a stern of a first vessel and a bow of a second vessel comprising:

a plurality of hawsers, comprising a first hawser adapted to be extended from a first anchor point on a port side of the stern of the first vessel and a second hawser adapted to be extended from a second anchor point on a starboard side of said first vessel, the first and the second hawsers constituting a first pair of hawsers extending to anchor points approximately adjacent to each other on the bow of the second vessel, with the hawsers being of approximately equal lengths; and a plurality of loading hoses arranged to be extended essentially centrally from approximately the midpoint of the stern of said first vessel to the bow of said second vessel.

2. The arrangement according to claim 1, wherein said plurality of hawsers comprise:

a second pair of hawsers, with a third hawser extending from near said first anchor point on the port side of the stern, and with a fourth hawser extending from near said second anchor point on the starboard side of the stern, with the second pair of hawsers being longer, or more elastic, than the other, first pair of hawsers.

3. The arrangement according to claim 2, wherein, the second pair of hawsers is 10–20% longer, or more elastic, than the other first pair of hawsers.

4. The arrangement according to claim 1, wherein, the lengths of said first pair of hawsers are comparable with the distance between said first and second anchor points at each respective port and starboard side of the stern.

5. The arrangement according to claim 4, wherein, the lengths of said first pair of hawsers connected to the port and starboard side respectively of the stern are between 1.5 and 2 times the mutual separation between said first and second anchor points.

6. The arrangement according to claim 5, wherein, for each of the said hawsers, said anchor point employs an extension device giving an increase of an effective total length of said hawser.

7. The arrangement according to claim 6, wherein, each of said extension devices further comprises a guide bushing by the stern and a hawser anchor point at a distance forward from the stern.

8. The arrangement according to claim 1, wherein, said plurality of loading hoses are extended between said stern of the first vessel and said bow of the second vessel, such that at least one of said loading hoses is arranged to transport a gaseous fluid, in the opposite direction of the fluid transfer of the other loading hoses.

9. The arrangement according to claim 1, further comprising:

a hose boom which is arranged to extend from said stern of the first vessel for elevating said loading hoses above the sea surface in the direction toward said bow of the second vessel.

10. The arrangement according to claim 1, further comprising:

a manifold device which is arranged on said bow of the second vessel with, ancillary swivels having an essentially horizontal axis arranged thwartships, wherein, the manifold device has a plurality of fluid ducts for connecting a plurality of loading hoses.

11. The arrangement according to claim 1, wherein the distance between the first anchor point and second anchor point on the stern of the first vessel is substantially larger than the distance between the anchor points on the bow of the second vessel.

12. The arrangement according to claim 1, wherein the first and second hawsers form the sides of an isosceles triangle having a base on the first vessel and an apex on the second vessel.

13. An arrangement for load transfer between two vessels at sea comprising:

a plurality of hawsers adapted to be extended from their respective anchor point on their respective side of the stern of the first vessel, to the bow of the second vessel, with the hawsers being of approximately equal lengths;

a plurality of loading hoses arranged to be extended essentially centrally from the midpoint of the stern of said first vessel to the bow of said second vessel;

a hose boom arranged to extend from said stern of the first vessel for elevating said loading hoses above the sea surface in the direction toward said bow of the second vessel; and a manifold device which is arranged on said bow of the second vessel comprising, ancillary swivels with an essentially horizontal axis arranged thwartships, wherein, the manifold device has a plurality of fluid ducts for connecting a plurality of loading hoses, wherein said plurality of hawsers further comprises two pairs of hawsers, with one pair of hawsers extending from anchor points on a first side of the stern, and with a second pair of hawsers extending from anchor points on a second side of the stern, with one of the hawsers in each pair being longer, or more elastic, than the other hawser in the pair.

14. A method for a load transfer between two vessels at sea comprising the steps of:

extending a plurality of a hawsers from their respective first and second anchor points on the port and starboard side, respectively, of the stern of a first vessel to anchor points approximately adjacent to each other on the bow of a second vessel, wherein the length of the hawsers are approximately equal; and extending a plurality of loading hoses from the midpoint of said stern of said first vessel to said bow of said second vessel.

15. The method according to claim 14, wherein in the step of extending a plurality of hawsers:

said plurality of hawsers comprise at least one second pair of hawsers such that the second pair of said hawsers is 10–20% longer, or more elastic, than the other, first pair of hawsers.

16. The method according to claim 14, wherein the step of extending a plurality of hawsers further comprises:

for each of the said hawsers, employing an extension device at said anchor point for said hawser for producing an increase of an effective total length of said hawser.

17. The method according to claim 14, wherein the step of extending a plurality of loading hoses further comprises:

extending said plurality of loading hoses between said stern of the first vessel and said bow of the second vessel, such that at least one hose is arranged to transport a gaseous fluid, in the opposite direction of the fluid transfer of the other loading hoses.

18. The method according to claim 14, wherein the step of extending a plurality of loading hoses further comprises:

elevating from said stern of the first vessel said loading hoses above the sea surface in the direction toward said bow of the second vessel.

19. The method according to claim 14, wherein the step of extending a plurality of loading hoses further comprises:

swiveling a manifold device on said bow of said second vessel about an essentially horizontal axis arranged thwartships, wherein, the manifold device has a plurality of fluid ducts for connecting a plurality of loading hoses.

20. The method according to claim 14, wherein the distance between the first anchor point and second anchor point on the stern of the first vessel is substantially larger than the distance between the anchor points on the bow of the second vessel.

21. The method according to claim 14, wherein the first and second hawsers form the sides of an isosceles triangle having a base on the first vessel and an apex on the second vessel.

* * * * *